US008506579B1

(12) United States Patent
Bareli et al.

(10) Patent No.: US 8,506,579 B1
(45) Date of Patent: Aug. 13, 2013

(54) HAIR THREADING CLIPS

(75) Inventors: Davira Bareli, Woodmere, NY (US); Mirona Mandel, New City, NY (US)

(73) Assignee: Davira Bareli, Woodmere, NY (US)

( * ) Notice: Subject to any disclaimer, the term of this patent is extended or adjusted under 35 U.S.C. 154(b) by 193 days.

(21) Appl. No.: 13/022,618

(22) Filed: Feb. 7, 2011

Related U.S. Application Data

(60) Provisional application No. 61/307,111, filed on Feb. 23, 2010.

(51) Int. Cl.
*A61B 17/50* (2006.01)

(52) U.S. Cl.
USPC ..... 606/133

(58) Field of Classification Search
USPC ..... 606/131, 133; 132/200, 212, 214, 132/323
See application file for complete search history.

(56) References Cited

U.S. PATENT DOCUMENTS

| | | | | |
|---|---|---|---|---|
| 1,588,387 | A * | 6/1926 | Li et al. | 606/133 |
| 4,754,768 | A * | 7/1988 | Jabouri | 132/212 |
| 5,908,425 | A * | 6/1999 | Adam | 606/133 |
| 5,951,573 | A * | 9/1999 | Yashar | 606/133 |
| 8,192,446 | B2 * | 6/2012 | Mueller | 606/133 |

* cited by examiner

*Primary Examiner* — Thomas McEvoy

(57) ABSTRACT

A set of clips, with finger placement for the use of fingers of both hands, and thread tied in a loop, slipped at a groove/notch/slot of each clip and then twisted, for the purpose of self threading (removing) hairs. The set of clips allows for a pain free experience when self threading using just a loop of thread around the fingers. The opening of the arms of the clips as well as the opening of the loop is comparable to the opening of the fingers when used with thread alone. Thus resulting in the exact duplication of threading done by a trained practitioner or self threading performed with a loop of thread.

8 Claims, 1 Drawing Sheet

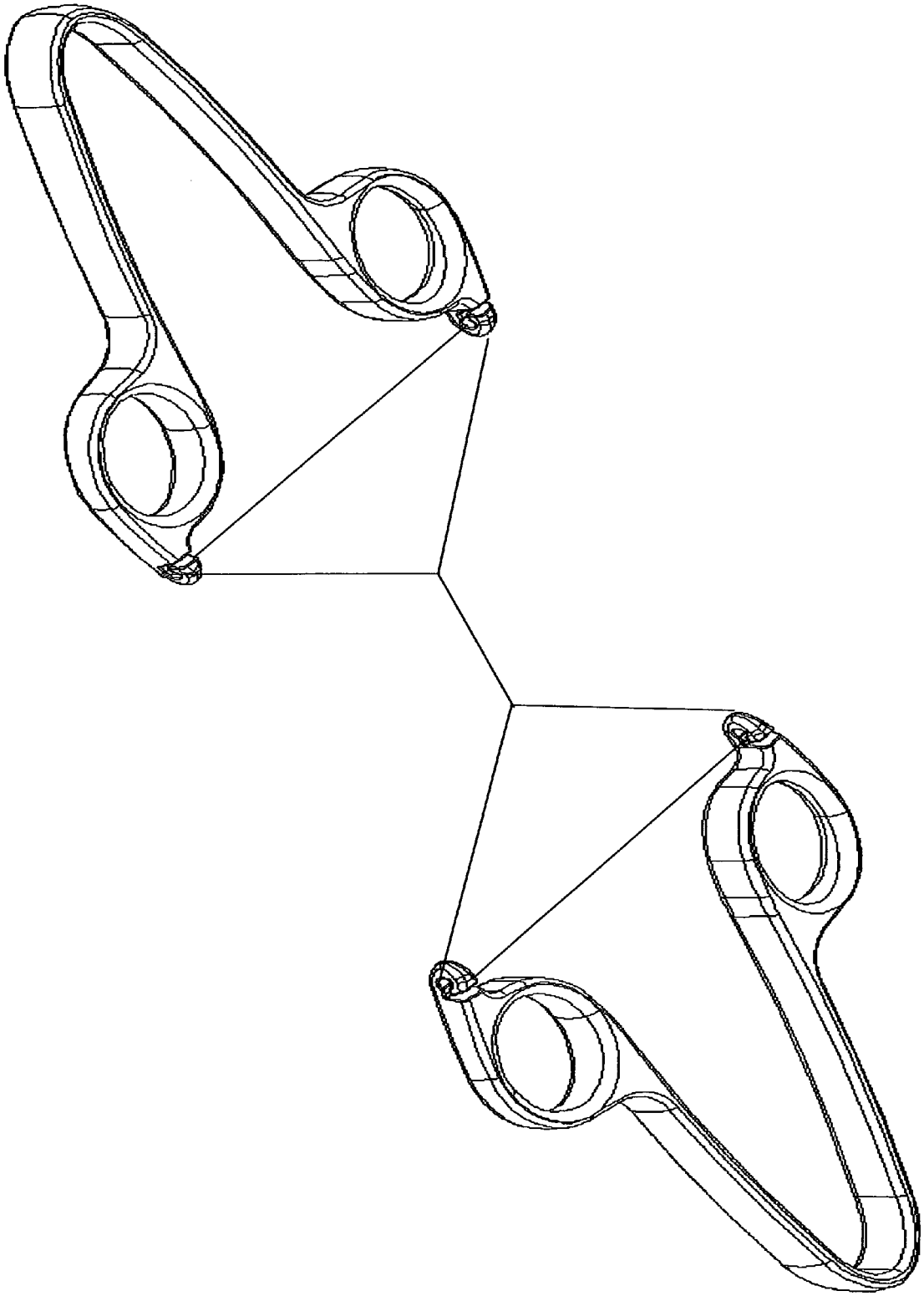

HAIR THREADING CLIPS

CROSS REFERENCE TO RELATED APPLICATION

This application claims priority, under 35 U.S.C. §119(e), to the U.S. Provisional Patent Application No. 61/307,111 filed on Feb. 23, 2010 which is incorporated herein by reference in its entirety.

BACKGROUND OF THE INVENTION

This invention relates generally to removal of facial hair by means of authentically duplicating the exact motions performed by a licensed aesthetician during the threading process. More specifically the present invention relates to self threading using a loop of thread with one knot while avoiding cuts and pains on the fingers during the procedure.

Hair threading is a widespread and very old technique of hair removal originating somewhere in India and the Middle East. Today we have seen an increase of threading being performed in beauty salons, however, due to the economy self threading to become more popular. Although self threading with the use of a piece of thread tied in a loop is an effective way of removing hair it is very painful as it cuts into the skin of the thumbs and index/middle fingers. Self threading is performed by cutting a piece of thread 2 feet long; knotting the ends together to form a loop. Holding one side of the loop in the left hand, using the right hand to twist the loop several times over and then pick up the other side. The loop should look like a large infinity symbol, with two teardrops on their sides facing in toward the twisted string that connects them. By placing the fingers inside the two teardrop shapes and by spreading out the fingers on one hand while bringing the fingers on the other hand close together while rolling the twisted thread over the hair and sliding the twisted thread from one hand to the other, the hair will be pulled out. The thread needs to be rolled over the skin several times to complete a desired area and causes cuts and pain in the fingers.

Various types of mechanical threading devices have been proposed and are known in the marketplace.

U.S. Pre-Grant Publication No. 20090030430 to Levi (2009) demonstrates a manual hair threading apparatus. The disadvantages of the device are that:

(a) It is single handed and therefore cannot give a smooth and long glide with tension along the skin thus removing just a couple of hairs at a time.

(b) It is not practical to use in places such as the eyebrows since the housing is distracting and possibly dangerous hovering just above and below the eye.

U.S. Pat. No 5951573 to Yashar (1999) and U.S. Pat. No 5908425 to Adam (1999) have the same disadvantages as disclosed with the above reference to Levi.

U.S. Pre-Grant Publication No. 20090012535 to Sun; Anita Schu-chiamet al. (2009). The disadvantages of the device are that:

(a) The product itself is so large and bulky and doesn't allow for precise removal of individual hair. It removes any and all hairs in its path.

(b) Also not practical for the eyebrows because of its size and housing.

(c) Also only 2 of the arms are mobile thus limiting control and length of the string as well as the openings at opposite ends,

SUMMARY OF INVENTION

The present invention, manual threading/depilatory hair removal clips is comprised of 2 devices, one for each hand, whereas the attached string is arranged in a twisted engagement forming 4 (four) ends and the pulling out of the hair occurs at the intersection of the entwined thread.

The hair engagement and removal assembly is suspended and held in the twisting action of the thread, while one of the finger placements (consisting of thumb and pointer) is closed while the other fingers on the other hand are open, This invention is the exact replication of self threading with a loop of thread around the thumb and index/middle finger of each hand. The premise is about keeping the feeling between the fingers and the device the same so that upon opening the device, the opening of the loop would be comparable to the opening of the fingers. Contact points are close to the finger placement.

In accordance with the present invention this depilatory/threading device is comprised of two (2) separate structures, one in each hand, with thread twisted at the center, held in tension to achieve its purpose. The present invention is the only one where the thread is the only material to touch the skin without having any of the housing blocking the view of the hair to be removed, provides the minimum number of parts, simplest method of assembly, most authentic in terms of movement of the thread, easiest of replacement of parts, no need of electricity or motors, uses less materials collectively, is lighter, and the cost of manufacturing is lower, in respect to all prior inventions known to me at the present time, The present invention has the following advantages:

(a) It is the most accurate as far as removing hair from any part of the face including eyebrows, upper lip, lower lip, chin, side of face, cheeks. Individual hairs are easily targeted as well as rows of many hairs.

(b) The user's view is never blocked by the housing.

(c) The linear movements are bi-directional, long and smooth with the use of both hands.

(d) It can be used privately or by professionals on the public.

BRIEF DESCRIPTION OF THE DRAWINGS

FIG. 1 shows the entire manual depilatory device in its normal rested position.

DETAILED DESCRIPTION OF THE DRAWINGS

FIG. 1 illustrates the invention showing the entire manual depilatory device in its normal rested position. FIG. 1 shows the 2 separate clips with the twisted thread attached at notches adjacent loops for finger placement.

While the above descriptions contain many specifications, these should not be constructed as limitations on the scope of the invention but rather as exemplifications of the preferred embodiments. Accordingly, the scope of the invention should be determined not by the embodiment illustrated, but by the appended claims and their legal equivalents. Many other variations are possible. For examples the clips may not necessarily have finger loops and may use other means of handling the device. Some sort of spring action may be added to the inner clips to increase flexibility. Larger and smaller varieties of the device may be produced for use on just the body or just face. Materials used to produce the clips can vary including different type of plastics, metal, wood, etc. Various types of strings can also be used such as silk, cotton, anti bacterial, etc. This device can be used anywhere on the body but is intended for the use of facial hair removal. It can also be used by men and woman although the slender, feminine look of the product was developed with women in mind.

The invention claimed is:

1. A hair removal device for removing hair from skin comprising:

A first clip or handle having a first arm and a second arm, the second arm connected to the first arm, the first arm having a first distal end and the second arm having a second distal end, the first clip being resiliently flexible;

A second clip or handle, independently movable relative to the first clip and having a third arm and a fourth arm, the fourth arm connected to the third arm, the third arm having a third distal end and the fourth arm having a fourth distal end, the second clip being resiliently flexible;

A hair removal string, wherein a first portion of the string is connected to the first distal end, a second portion of the string is connected to the second distal end, a third portion of the string is connected to the third distal end and a fourth portion of the string is connected to the fourth distal end, wherein the string has a first segment spanning between the first distal end and the third distal end and a second segment spanning between the second distal end and the fourth distal end, wherein the first segment and second segment are twisted together so that the string forms a loop twisted about itself, wherein the first clip can be held in a first hand and the second clip can be held in a second hand to provide bi-directional movement to the string so that a hair and attached hair follicle can be removed from skin.

2. The device of claim 1, wherein a finger loop is attached to each of the first, second, third and fourth distal ends, wherein a thumb or index finger can be placed into any of the loops during operation of the device.

3. The device of claim 2, wherein each of the first, second, third and fourth portions are connected to the respective first, second, third or fourth arms at a location immediately adjacent to the respective finger loop so that the movement of the string is perceived by a user as if caused directly by finger movement.

4. The device of claim 1, wherein the bi-directional movement of the string causes removal of the hair follicle from the direction it is growing.

5. The device of claim 1, wherein the involvement of the first and second hands allows for a smooth and long glide of the string with tension along the skin so that more than one hair can be removed at a time.

6. The device of claim 1, wherein each of the first, second, third and fourth distal ends has a notch and the string is attached to the first and second clips using the notches.

7. The device of claim 1, wherein the clips allow movement of the string and removal of a hair without requiring the string to be looped around fingers of a user so that the string does not cause pain to the fingers.

8. A method of removing target hair from skin comprising:

providing the hair removal device of claim 1;

causing bi-directional movement of the string so that a hair and attached hair follicle are removed from skin.

* * * * *